United States Patent [19]

Reiman

[11] 4,369,606

[45] Jan. 25, 1983

[54] ABRASIVE HEAD

[75] Inventor: Ralph E. Reiman, Indianapolis, Ind.

[73] Assignee: Grinding & Polishing Machinery Corp., Indianapolis, Ind.

[21] Appl. No.: 186,233

[22] Filed: Sep. 11, 1980

[51] Int. Cl.[3] ..... B24D 9/06

[52] U.S. Cl. ..... 51/334; 51/335; 51/337; 51/361; 15/183

[58] Field of Search ..... 15/183; 51/334–337, 51/359–361

[56] References Cited

U.S. PATENT DOCUMENTS

| | | | |
|---|---|---|---|
| 639,660 | 2/1899 | Condon et al. . | |
| 1,576,450 | 3/1926 | Nielsen . | |
| 1,989,078 | 1/1935 | Brostrom . | |
| 2,259,475 | 10/1941 | Koether . | |
| 2,398,664 | 4/1946 | Paul . | |
| 2,430,099 | 11/1947 | Bradley | 51/335 |
| 2,599,961 | 6/1952 | White . | |
| 2,601,499 | 6/1952 | Bruner | 51/335 |
| 2,653,340 | 9/1953 | Cave | 15/183 |
| 2,675,653 | 4/1954 | Bryant . | |
| 2,713,759 | 7/1955 | Swan | 51/335 |
| 3,134,123 | 5/1964 | Nelson | 15/183 |
| 3,533,125 | 10/1970 | Buechel et al. | 15/183 |
| 3,862,463 | 1/1975 | Reiter | 15/183 |

*Primary Examiner*—James L. Jones, Jr.
*Assistant Examiner*—K. Bradford Adolphson
*Attorney, Agent, or Firm*—Woodard, Weikart, Emhardt & Naughton

[57] ABSTRACT

An abrasive head including a plurality of radially extending brushes interspaced with abrasive strips. The brushes are secured by brush holders between a pair of parallel plates with the holders having overlapping mounting flanges secured together to one of the plates. A pair of hubs mounted to the plates receives a rotatable spindle upon which the head is mounted. A pair of wrench-engageable lock plates engages stop surfaces on the hubs limiting relative motion therebetween. A holder within the head adjustably secures a plurality of abrasive strips rolled upon each other having free distal ends located between the brushes.

11 Claims, 6 Drawing Figures

ABRASIVE HEAD

BACKGROUND OF THE INVENTION

This invention relates to an abrasive head of the type that may be employed in smoothing products of wood and other materials including mouldings, carvings, die castings and the like. The improvement is based upon an earlier abrasive head which is disclosed in U.S. Pat. No. 2,430,099. The improvement relates to the mounting provisions for the brush holders secured within the head upon which centrifugal force is exerted as the head is rapidly rotated. Further, a more economical method is employed for mounting the head to a spindle by including a pair of cylindrical hubs, each having an outer cylindrical flange flattened in one location providing a stop surface engaged by a pair of wrench-engageable plates mounted to the head.

SUMMARY OF THE INVENTION

One embodiment of the present invention is an abrasive head mountable on a rotatable spindle comprising a pair of spaced-apart and parallel plates having centrally located mounting means operable to mount the plates on the spindle to rotate therewith on an axis of rotation, a plurality of outwardly extending brushes spaced from each other around the axis and mounted to at least one of the plates, a plurality of abrasive strips rolled upon each other within the head and including free distal ends extending outwardly therefrom each between separate adjacent brushes, holding means mounted to the plates inwardly of the brushes and being adjustably engaged with the strips and operable to hold the strips, a plurality of brush holders mountingly engaging and removably holding the brushes to at least one of the plates, the brush holders each having a main body with a back wall and a pair of side walls extending in a converging direction from the back wall forming a U-shaped cross section holding a brush therein, the back wall and side walls extending parallel to the axis and each having at least one end secured to one of the plates, the side walls at the one end have mounting flanges extending outwardly therefrom with the flanges of each holder longitudinally offset in the direction of the axis and with flanges of each holder overlapping and secured to mounting flanges of adjacent holders, the back wall has a mounting flange extending toward the axis and secured to one of the plates.

Another embodiment of the present invention is an abrasive head mountable on a rotatable spindle, a first plate and a second plate spaced apart and parallel having a centrally located hole extending therethrough to receive a spindle rotatable on an axis of rotation, a plurality of outwardly extending brushes spaced from each other around the axis and positioned between the first plate and second plate, brush holders securing the brushes between the first plate and second plate, a plurality of abrasive strips rolled upon each other within the head and including free distal ends extending outwardly therefrom between adjacent brushes, first means mounted to the first plate and second plate holding the strips therebetween, a first cylindrical hub and a second cylindrical hub extending respectively through the first plate and the second plate and also into the means, the first and second hub having a flange located externally adjacent respectively the first plate and the second plate with each flange having a stop surface thereon, second means locking each hub to the first means, and a first hub-lock and a second hub-lock fixedly secured respectively to the first plate and the second plate and each having a wrench-engageable external surface and an internal surface engaged with the stop surface limiting relative motion therebetween, the first hub-lock also being fixedly secured to the first means limiting relative motion therebetween.

It is an object of the present invention to provide a new and improved abrasive head.

A further object of the present invention is to provide an abrasive head having improved mounting means for securing brushes within the head.

Yet another object of the present invention is to provide a new and improved abrasive head having a relatively inexpensive mounting configuration receiving a rotatable spindle.

Related objects and advantages of the present invention will be apparent from the following description.

DESCRIPTION OF THE PREFERRED EMBODIMENTS

Figure 6:
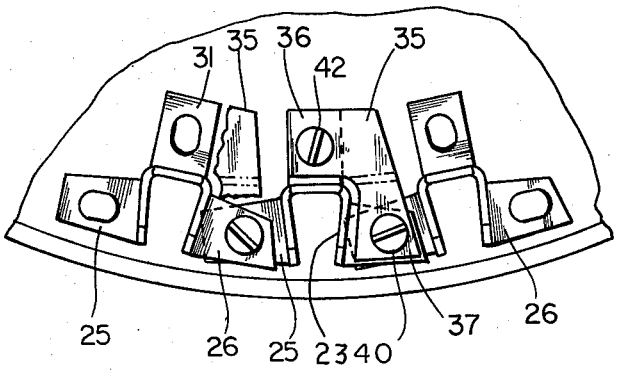
FIG. 6 is an enlarged fragmentary front elevation of the brush holders and clips shown in FIG. 2.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 1:
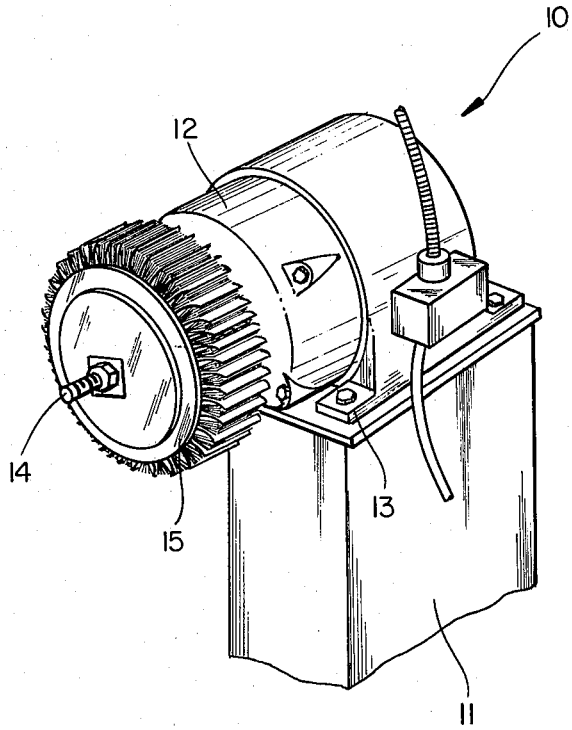
FIG. 1 is a perspective view of the abrasive head mounted in position for the sanding operation.

Referring now more particularly to FIG. 1, there is illustrated an abrasive or polishing unit 10 having a supporting base 11 upon which there is mounted an electric motor 12 by flanges 13. Motor 12 is driven from any suitable source of current not illustrated. Extending from the motor 12 is a driven rotatable spindle 14 for supporting and rapidly rotating the abrasive head 15. While although motor 12 is shown as having a single spindle 14 and head 15, it is to be understood that additional spindles and heads may be driven by the motor.

Figure 2:
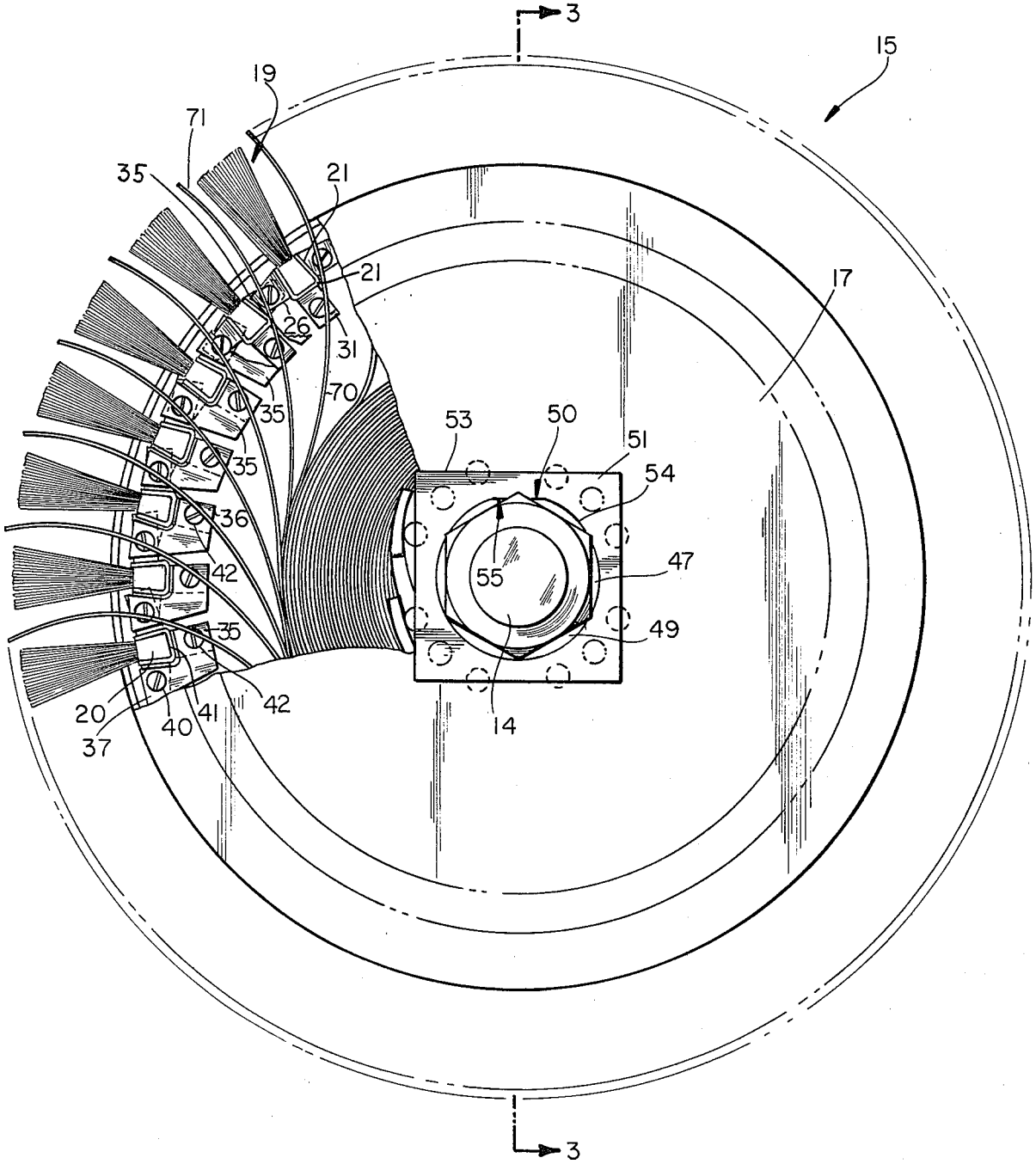
FIG. 2 is an enlarged fragmentary front elevation of the head assembled for use.
Figure 3:
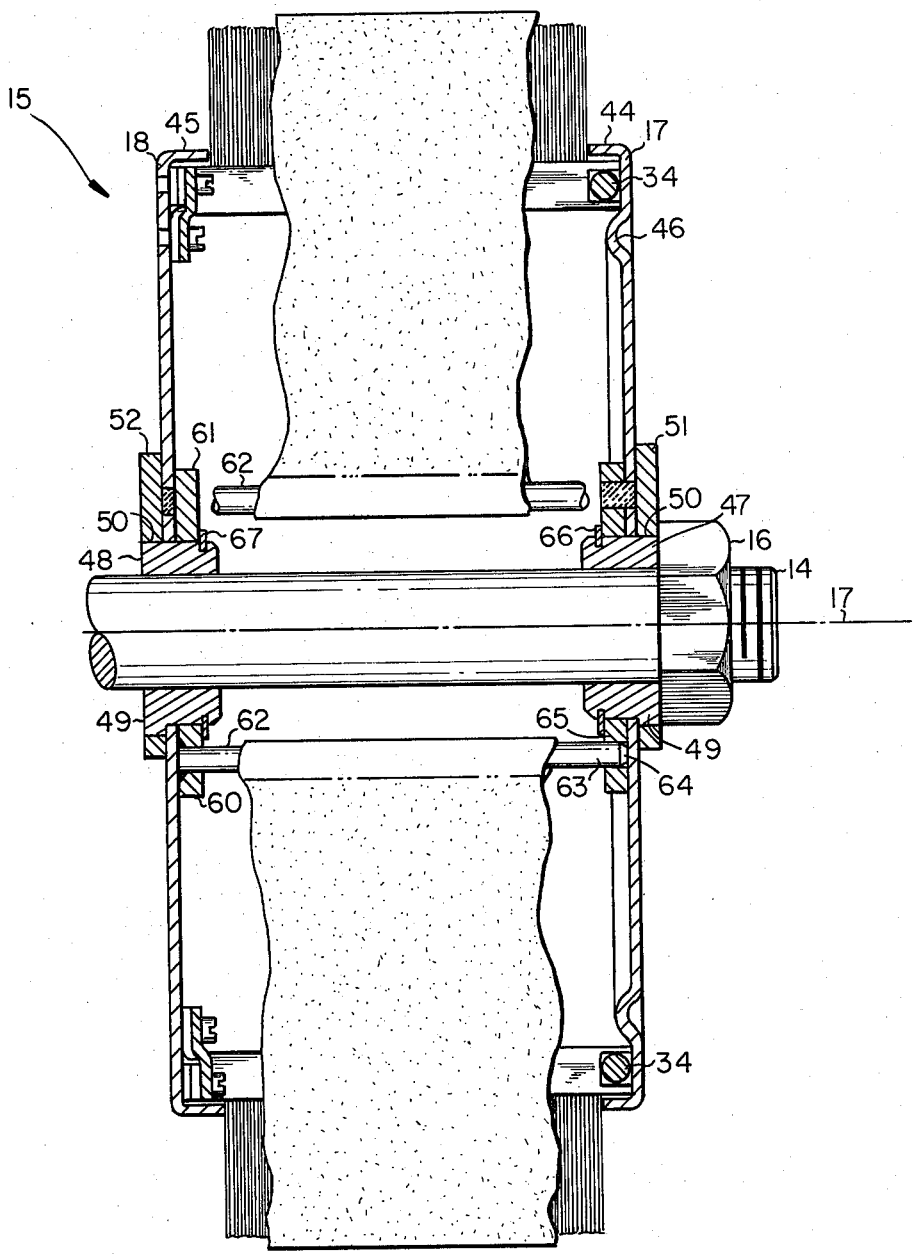
FIG. 3 is a cross-sectional view taken along line 3—3 of FIG. 2 and viewed in the direction of the arrows.

An enlarged view of abrasive head 15 is shown in FIGS. 2 and 3. Head 15 is removably mounted to spindle 14 and is secured thereon by a conventional hexagonally shaped nut 16 threadedly received by the distal end of spindle 14. Head 15 includes a front plate 17 and back plate 18 which are parallel and spaced apart having a centrally located and aligned hole through which spindle 14 extends. Head 15 thereby rotates with spindle 14 on an axis of rotation 17. A plurality of outwardly extending brushes 19 extends radially in a direction from the axis of rotation. Brushes 19 are located around the entire periphery of the abrasive head and are closely spaced together extending between plates 17 and 18. Each brush 19 has a relatively rigid base 20 (FIG. 2) from which a plurality of strands extend from the abrasive head with the back surface 41 of the base 20 located adjacent the back wall of the holder. The mounting base 20 of each brush is slidably received in a separate brush holder 21 mounted to at least one of the plates 17 and 18.

Figure 4:
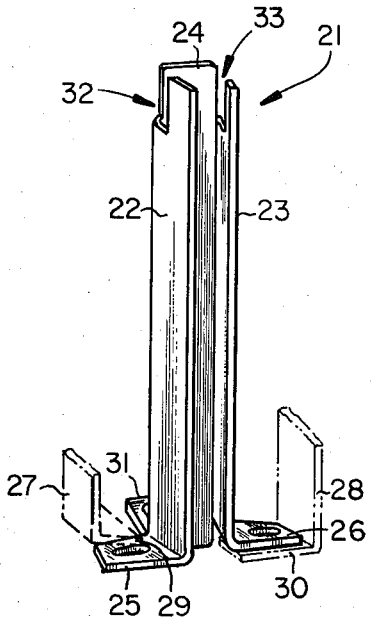
FIG. 4 is an enlarged perspective view of one of the brush holders.

A perspective view of a brush holder 21 is shown in FIG. 4 and includes a pair of side walls 22 and 23 integrally joined together by an intermediate back wall 24. Side walls 22 and 23 extend in a converging direction from back wall 24 and complementarily receive base 20 of the brush as the brush is slid between the side walls. As shown in FIG. 4, side walls 22 and 23 form with back wall 24 a generally U-shaped cross section with both side walls and back wall extending in a direction parallel to the axis of rotation once the holders are mounted to plate 18. Three mounting flanges are provided at one end of walls 22–24. Mounting flanges 25 and 26 are integrally joined respectively to side walls 22 and 23 and extend outwardly therefrom with the flanges being parallel to each other but offset along the longitudinal axis of the holder. Likewise, flange 25 is longitudinally offset from flange 26 in the direction of the axis of rotation 17 thereby allowing the flanges of each holder to overlap the mounting flanges of an adjacent holder. For example, holder 21 is shown in FIG. 4 as being located between adjacent holders 27 and 28 which are shown as fragmentary and in phantom. One mounting flange 29 of the side wall associated with holder 27 is located atop mounting flange 25 of holder 21 whereas mounting flange 30 of the side wall associated with holder 28 is located beneath and adjacent mounting flange 26. The mounting flanges are provided with apertures through which a conventional fastener such as a screw extends being received by the back plate 18 thereby securing the holders to the head. Further, back wall 24 is provided with a mounting flange 31 which extends inwardly toward the axis of rotation with mounting flange having an aperture through which a threaded member extends into the back plate thereby securing the holder to the back plate. Flange 31 is longitudinally aligned with flange 25, but offset from flange 26.

The end of holder 21 opposite the mounting flanges includes a pair of aligned recesses 32 and 33, respectively, in side walls 22 and 23 and receive a continuous ring 34 (FIG. 3) extending through all of the brush holders thereby securing the holders together.

Figure 5:
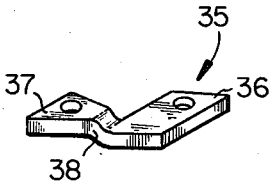
FIG. 5 is an enlarged perspective view of an optional clip used with the brush holder of FIG. 4.

A plurality of optional clips (FIG. 5) may be used to distribute the force exerted on the brush holders as the head is rotating and exerting centrifugal force on the holders. Each clip 35 has a pair of ears 36 and 37 integrally joined together by an upwardly extending intermediate portion 38. Ears 36 and 37 are parallel but are located in offset planes since mounting flange 26 of the holder is located in a plane parallel to but offset from the plane containing mounting flanges 25 and 31 of the holder. Clip 35 is shown in fragment in FIG. 6 as associated with the holder depicted in the left portion of the view with a second clip 35 shown without fragment as securing the adjacent holder. Ear 37 is positioned atop the mounting flange extending outwardly from side wall 23 of the holder with ear 36 positioned atop the mounting flange extending radially inward and attached to the back wall 24 of the holder. Both ears of the clip are provided with an aperture through which a conventional threaded member extends. For example, threaded member 40 (FIG. 6) extends through ear 37 of the clip and through the overlapping and adjacent mounting flanges of the holders whereas fastener 42 extends through ear 36 and the mounting flange attached to the back wall of the holder. Threaded members 40 and 42 are threadedly received by the back plate 18 thereby securing the holders and clip to the back wall. It should be noted that the apertures provided in the mounting flanges attached to the side walls and back wall of each holder along with the apertures extending through both ears of each clip have a continuous periphery extending therearound. In other words, the apertures are not open to the side and have a material, such as metal, extending continuously around the aperture. Thus, in the event the holders are moved slightly by the force exerted during the rapid rotation of the head, the material defining the holes will limit movement by contacting the threaded members extending through the aperture.

Plates 17 and 18 have aligned and mutually facing circumferential edge portions 44 and 45 (FIG. 3) which extend in the direction of axis 17 adjacent brush holders 21 thereby limiting the outward movement of the holders as the head is rotated. Further, plate 17 is provided with an inwardly extending continuous bead 46 extending around axis 17 immediately adjacent and inward of the brush holders.

A pair of cylindrical hubs 47 and 48 project respectively through the central aperture provided in plate 17 and 18 and in turn have an aligned hole extending therethrough through which spindle 14 is extendable. Each hub 47 and 48 have an outer flange 49 located outwardly of and adjacent plates 17 and 18 with flange 49 being of a diameter larger than the main body of the hub. A portion of the flange 49 is flattened providing a stop surface 50 on each hub in turn engaged by a pair of hub-lock plates 51 and 52 located outwardly of and immediately adjacent plates 17 and 18. Each plate 51 and 52 is provided with an external surface engageable by a wrench and an inwardly facing surface engaging the circumference of flange 49. For example, plate 51 is provided with an outwardly wrench-engaging surface 53 (FIG. 2) and an aperture 54 through which flange 49 extends with aperture 54 complementarily receiving flange 49 providing a surface 55 engaging stop surface 50 thereby limiting relative motion between the hub flange and the hub-lock plate. Both flanges 51 and 52 are welded respectively to plates 17 and 18.

A plurality of abrasive strips are rolled upon each other within the head and extend between the brushes such as disclosed in U.S. Pat. No. 2,430,099 hereby incorporated by reference. Means is provided for mounting the abrasive strips within the head. The means 60 (FIG. 3) includes a flat plate 61 having a plurality of rods 62 welded thereto in cantilevered fashion with the distal ends 63 of the rods extending into and received by a plurality of holes 64 provided in a second flat plate 65 welded to plate 17. Plate 61 is not welded to plate 18, but is held in position by snap ring 67. Hubs 47 and 48 extend freely through plates 65 and 61, respectively, with snap rings 66 and 67 respectively mounted to hubs 47 and 48 and extending adjacent respectively plates 65 and 61 thereby limiting longitudinal movement along axis 17 of the hubs as well as plates 65 and 61.

As the abrasive strips wear, it is desirable to move the abrasive strips relative to the brushes allowing the distal ends of the strips to be moved outwardly. When fresh abrasive strips are required, the head is stopped from rotating and spindle nut 16 is loosened to allow plate 17 to be rotated relative to the head. Plates 51 and 52 are engaged with a pair of wrenches with rotation of plate 51 causing plate 17 and plate 65 to rotate thereby carrying or rotating rod members 62 about axis 17. Plate 60 will rotate about axis 17 while plate 18 and hub-lock plate 52 are held stationary in turn holding the brush holders and brushes in a stationary position thereby causing the abrasive strips to move outwardly relative to the brushes. The movement thus described is achieved since hub-lock plate 51 is welded to plate 17 along with plate 65 whereas plate 52 is welded to plate 18 which in turn is not welded to plate 61.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. An abrasive head mountable on a rotatable spindle:

a first plate and a second plate spaced apart and parallel having a centrally located hole extending therethrough to receive a spindle rotatable on an axis of rotation;

a plurality of outwardly extending brushes spaced from each other around said axis and positioned between said first plate and second plate;

brush holders securing said brushes between said first plate and second plate, said holders having parallel but offset side mounting flanges with said flanges of each holder overlapping and secured to flanges of adjacent holders and to said first plate, said holders also each having a rear flange secured to said first plate;

a plurality of abrasive strips mounted within said head and including free distal ends extending outwardly therefrom between adjacent brushes;

first means mounted to said first plate and second plate holding said strips therebetween; and, a plurality of clips, each extending between and secured to one of said side mounting flanges and a rear flange of said holders distributing force therebetween as said head is rotated exerting centrifugal force on said holders.

2. The abrasive head of claim 1 wherein said brush holders each have a main body with a back wall and a pair of side walls extending in a converging direction from said back wall forming a U-shaped cross section holding a brush therein.

3. The abrasive head of claim 1 wherein said clips each have a first ear and second ear integrally joined together and extending in a parallel direction but in offset planes, each ear having a fastener hole extending therethrough.

4. An abrasive head mountable on a rotatable spindle comprising:

a pair of spaced-apart and parallel plates having centrally located mounting means operable to mount said plates on said spindle to rotate therewith on an axis of rotation;

a plurality of outwardly extending brushes spaced from each other around said axis and mounted to at least one of said plates;

a plurality of abrasive strips rolled upon each other within said head and including free distal ends extending outwardly therefrom each between separate adjacent brushes;

holding means mounted to said plates inwardly of said brushes and being adjustably engaged with said strips and operable to hold said strips;

a plurality of brush holders mountingly engaging and removably holding said brushes to at least one of said plates, said brush holders each having a main body with a back wall and a pair of side walls extending in a converging direction from said back wall forming a U-shaped cross section holding a brush therein, said back wall and side walls extending parallel to aid axis and each having at least one end secured to one of said plates, said side walls at said one end have mounting flanges extending outwardly therefrom with said flanges of each holder longitudinally offset in the direction of said axis and with flanges of each holder overlapping and secured to mounting flanges of adjacent holders, said back wall has a mounting flange extending toward said axis and secured to one of said plates; and, a plurality of clips, each extending between and secured to one of said mounting flanges of said side walls and a mounting flange of said back wall distributing force therebetween as said head is rotated exerting centrifugal force on said holders.

5. The abrasive head of claim 4 wherein said clips each have a first ear and a second ear integrally joined together and extending in a parallel direction but in offset planes, each ear having a fastener hole extending therethrough.

6. The abrasive head of claim 4 and further comprising a plurality of fasteners extending through one of said plates and through said mounting flanges of said side walls which are overlapped fixedly holding said holders at said one end of said holders.

7. The abrasive head of claim 6 wherein said mounting flanges of said side walls of said holders extend in a direction toward adjacent holders with each of said mounting flanges of said side walls including a hole which has a continuous surrounding periphery limiting movement of said fasteners relative to said mounting flanges.

8. The abrasive head of claim 4 wherein said plates have aligned and mutually facing circumferential edge portions extending in the direction of said axis adjacent said brush holders limiting outward movement of said holders as said head is rotated.

9. The abrasive head of claim 4 wherein said mounting means includes a pair of cylindrical hubs and a pair of hub-lock plates, said hubs each have a stop surface contactable against said hub-lock plates limiting relative motion therebetween, said hubs having means through which said spindle is extendable.

10. The abrasive head of claim 9 wherein said hub-lock plates are located outwardly of and adjacent to said pair of plates and are fixedly secured thereto preventing relative motion therebetween.

11. The abrasive head of claim 10 wherein one of said hub-lock plates is welded to one of said pair of plates and said holding means.

* * * * *